United States Patent [19]

Chardonneau et al.

[11] 3,959,967

[45] June 1, 1976

[54] RECIPROCATING APPARATUS PARTICULARLY FOR PUMP UNIT

[75] Inventors: Jöel Chardonneau, Nantes; Claude Sablé, Rezë, both of France

[73] Assignee: Centre d'Etudes et de Realisations Industrielles de l'Atlantique C.E.R.I.A., Nantes, France

[22] Filed: June 6, 1975

[21] Appl. No.: 584,285

[52] U.S. Cl. ..... 60/382; 60/391; 60/446; 74/25; 74/96; 251/251; 417/390; 417/539

[51] Int. Cl.[2] ..... F16H 39/46

[58] Field of Search ..... 60/369, 381, 388, 391, 60/446, 382; 91/339, 340; 417/390, 343, 539, 315, 518, 510; 251/251; 74/35, 96

[56] References Cited

UNITED STATES PATENTS

| | | | |
|---|---|---|---|
| 2,839,865 | 10/1974 | Chardonneau et al. | 60/382 X |
| 2,910,831 | 11/1959 | Gatwood | 60/381 |
| 3,055,225 | 9/1962 | Miller | 251/251 X |
| 3,482,399 | 12/1969 | Lawson | 60/382 |
| 3,772,888 | 11/1973 | Orlando | 60/391 X |
| 3,868,820 | 3/1975 | Lawson | 60/446 X |

*Primary Examiner*—William L. Freeh
*Assistant Examiner*—Edward Look
*Attorney, Agent, or Firm*—Cushman, Darby & Cushman

[57] ABSTRACT

A system is provided for maintaining a permanent reciprocatory movement of a mechanical arrangement, particularly a pump unit. A main driving wheel is coupled to the mechanical arrangement and fastened on the shaft of a hydraulic motor which is supplied by a variable delivery pump provided with control means. The control means is coupled to the wheel by a drive mechanism which comprises a rocking lever coupled to the control means and a cam carrier wheel rotationally fixed to the wheel. As the mechanical arrangement moves in one direction, the rotation of the driving wheel causes the cam wheel to change the position of the rocking lever thus permitting the control means to direct the flow of fluid from the variable delivery pump to the hydraulic motor to reverse the direction of travel of the mechanical arrangement.

13 Claims, 9 Drawing Figures

RECIPROCATING APPARATUS PARTICULARLY FOR PUMP UNIT

BACKGROUND OF THE INVENTION

The present invention relates generally to driving devices intended to impart a permanent reciprocating movement to a mechanical element. More particularly, the invention relates to a device for maintaining a rectilinear or rotational oscillatory movement of an element or group of elements, such as a pump unit.

It is an object of the invention to provide a driving device of the type indicated above which through the use of simple and reliable mechanisms makes it possible to obtain a permanent reciprocating movement of which both the amplitude and the frequency can be controlled with great ease.

SUMMARY OF THE INVENTION

It thus relates to a device for maintaining a permanent reciprocating movement of a mechanical arrangement, particularly a pump unit comprising a wheel coupled to the mechanical arrangement and fastened on the shaft of a hydraulic motor which is supplied by a variable delivery pump provided with control means which, through a change of position, reverses the flow of the said pump, the device comprising in addition a drive mechanism for coupling the said control means to the said wheel, said drive mechanism comprising a mechanical transmission mechanism containing a rocking lever coupled to the said control means, a cam carrier wheel rotationally fixed to the said wheel and carrying two angularly spaced cams on the periphery of the cam carrier wheel, each cam having an inclined surface arranged to effect rocking of said lever respectively to one or the other of its positions, and a circular surface for holding the lever in the position to which it has rocked for a ceratin period of time after the rocking, a resilient device being provided which is connected between the said lever and the cam carrier wheel to keep the lever and the cams coupled during this period of time.

DESCRIPTION OF THE PREFERRED EMBODIMENTS

The embodiment of the invention which will now be described relates to the application of the apparatus of the invention to a petroleum pumping installation, but it is clearly to be understood that this apparatus is not limited solely to this application. On the contrary, it can be used whenever a rectilinear or rotational reciprocating movement has to be maintained.

Figure 1:
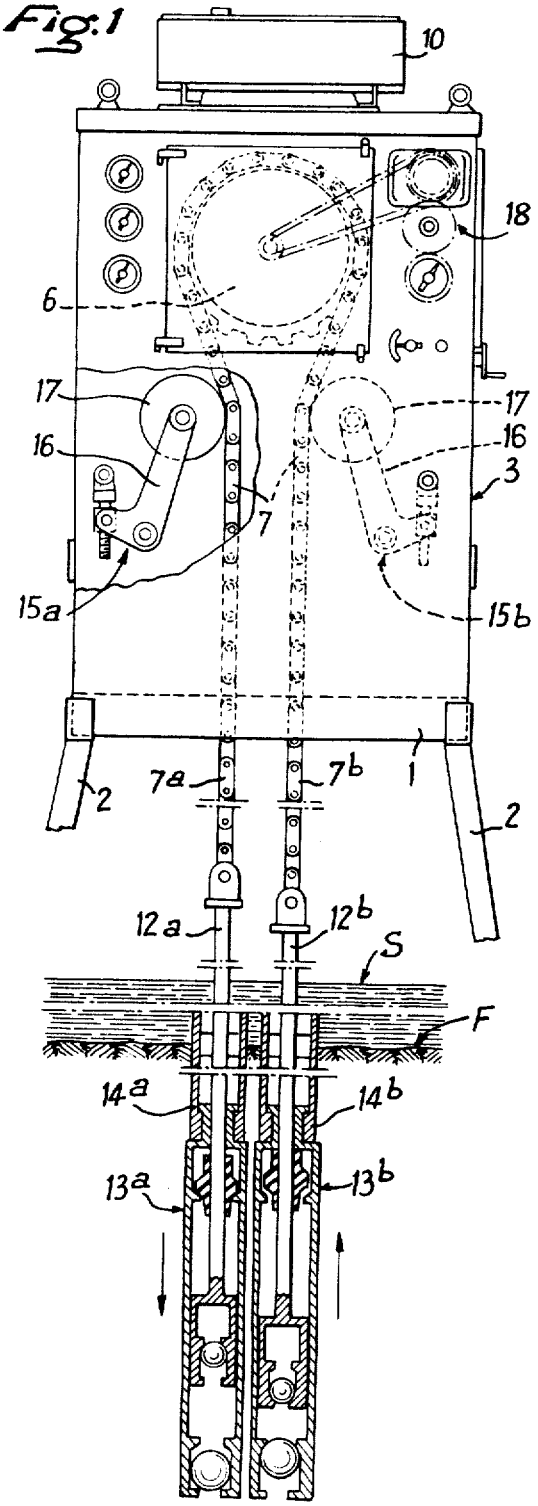
FIG. 1 is a diagrammatical view in elevation of an apparatus for maintaining a reciprocal movement, which is used to drive a petroleum pump unit.
Figure 2:
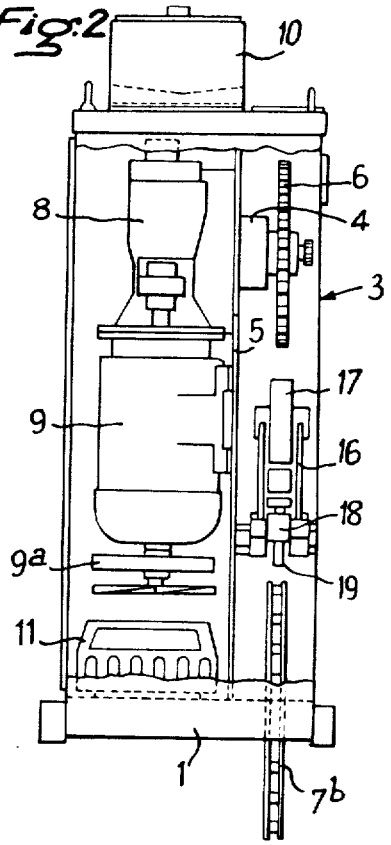
FIG. 2 is a side view of this apparatus.

FIGS. 1 and 2 show a platform 1 mounted on a framework 2 resting on the seabed F, the apparatus being intended to drive the pumps of an oil well under the sea.

The platform 1 supports a housing 3 containing the movement reversing device. In FIGS. 1 and 2, some of the outside panels of this housing have been omitted in order to reveal the elements contained therein.

A hydraulic motor 4 is fixed on a partition 5 of the cabinet 3, a sprocket wheel 6 being fastened on its output shaft. The sprocket wheel 6 engages with a link chain 7 whose two sides **7*a* and 7*b* extend downwards and pass through the platform 1**.

The hydraulic motor 1 is connected to a variable delivery pump 8 which is driven by an electric motor 9, the assembly comprising the pump and the motor being fixed on the partition 5. A flywheel **9*a* fastened on the shaft of the motor 9** ensures that the latter rotates at constant speed.

An oil tank 10 is fixed on the cabinet 3, while an oil cooling device 11 is supported on the bottom of the cabinet. This cooling device may be of the forced ventilation type.

At its ends the chain 7 is fastened to trains of rods **12*a* and 12*b* operating two petroleum pumps 13*a* and 13*b* disposed respectively in tubings 14*a* and 14*b*** of two oil wells drilled side-by-side in the seabed F. The pumps are of conventional type and are provided with all the usual accessories known in the art.

Two devices **15*a* and 15*b* for controlling the paths of the sides 7*a* and 7*b* of the chain 7 are mounted on the partition 5 of the housing 3. Each of these devices comprises a bent lever 16 articulated on the partition 3 and carrying at the end of one of its branches a free roller 17 which is in contact with the corresponding side of the chain 7. The other branch of the bent lever 16 is fixed adjustably on the partition 5, the arrangement being such that the rotation of the screw effects a rotation of the lever about its articulation axis and consequently a variation of the position of the corresponding roller 17. This arrangement thus makes it possible for the pumping apparatus to be adapted to different distances between the pumps 13*a* and 13*b*** and consequently to different pumping sites.

The apparatus of the invention also comprises a drive mechanism 18, of which a preferred form of construction will now be described with the aid of FIG. 3.

It should be noted that the variable delivery pump 8 is of the type comprising a drive element whose angular position defines the value of the delivery. In the present case this drive element is a lever 21 articulated on the body of the pump. A pump of this kind is known in the art and available commercially.

At its free end the lever 21 is attached to the rod of a power cylinder 22 intended to control its position. This power cylinder 22 is connected in a hydraulic circuit containing a distributor 23 which is fed by an auxiliary pump 24. The latter may be the booster pump of the main pump 8. A calibrated orifice 25, of adjustable dimensions is inserted in one of the pipes feeding the power cylinder 22.

The distributor 23 is controlled by a slide 26 sliding in a fixed mounting 27 and adapted to occupy two positions, which are defined by a ball 28 loaded resiliently and co-operating with two notches 29 formed in the slide 26. The ball 28 is accommodated in a radial hole provided in the mounting 27.

A transmission mechanism 30 contains a lever 31 which is pivotably mounted on a fixed yoke 32 and articulated at one of its ends on the slide 26. In this lever is mounted telescopically a rod 33 which at its free end carries a yoke 34 supporting a free roller 35.

The rod 33 slides in a stepped hole 36 in the lever 31 and is urged outwards by a spring 37 bearing against a collar 38 on the rod 33 and the radial shoulder 39 of the hole 34. A nut 40 screwed into the end of the lever 31 retains the rod 33.

The transmission mechanism 30 also contains a cam carrier wheel 41 mounted for rotation on a shaft 42 suitably supported in the housing 3. The wheel 41 is rotationally fixed to a sprocket 43 engaging with an endless chain 44 which is driven by a driving pinion 45 fastened to the main wheel 6.

The cam carrier wheel 41 carries two cams 46 of identical shape. Each of them has a front inclined surface 47 and a circular surface 48, the inclined surfaces being disposed angularly facing one another.

The cams 46 are fixed on the wheel 41 by means of bolts 49 passing through a hole 50 of curved shape and by means of nuts 50 screwed on the bolts. The latter are fastened to the cam carrier wheel 41.

The operation of this apparatus is as follows.

The electric motor 9 drives the pump 8 feeding the hydraulic motor 4, so that the wheel 6 performs a reciprocating rotational movement which is imparted to the chain 7. For this purpose the delivery of the pump 8 is reversed in a given rhythm which determines the frequency of the reciprocating movement of the two sides 7*a* and 7*b* of the chain 7.

The delivery control lever 21 is operated by the power cylinder 22, which receives a feed pressure acting alternately on the two faces of its piston. The distributor 23 controlling this alternation is reversed by the lever 31 with the aid of the slide 26.

The reversal of the position of the lever 31 is effected in two stages by the alternating rotation of the wheel 41 in opposite directions.

Firstly, the inclined surface 47 of the cam 46 in question pushes against the roller 35, thus driving the lever 31, without the latter undergoing any longitudinal deformation because the spring 37 is given sufficient strength to ensure that the force necessary for moving the slide 26 does not change the length of the lever. The slide 26 therefore passes from one position to the other.

As soon as the lever 31 has rocked, the distributor 23 reverses the feeding of the power cylinder 22. The delivery of the pump 8 is therefore reversed at the end of a certain period of time. During this period of time the roller 35 moving on the area 48 deforms the spring 37 and therefore holds the lever 31 in the position to which it has rocked, the slide 26 also being stationary. The risk that the lever might abruptly rock back to the other position at an inopportune moment in the operating cycle is thus eliminated.

The reversal of the direction of rotation of the wheel 6 having been effected, the roller 35 returns on the surface 48 of the cam 46, and then leaves that surface without acting on the distributor 23, which cannot be operated again except by the other cam, which causes the lever 31 to rock back.

It will be understood that the angular spacing of the cams 46 determines the total length of movement of the chain 7 or of the pumps 13*a* and 13*b*, and that the individual angular position of each of the cams makes it possible for the "top" and "bottom" points of these pumps to be respectively regulated.

It is also possible to control the rapidity of the reversal and therefore to determine the accelerations at the moment of the reversals by controlling the feed flow of the power cylinder 22 with the aid of the adjustable throttle 25.

Figure 3:
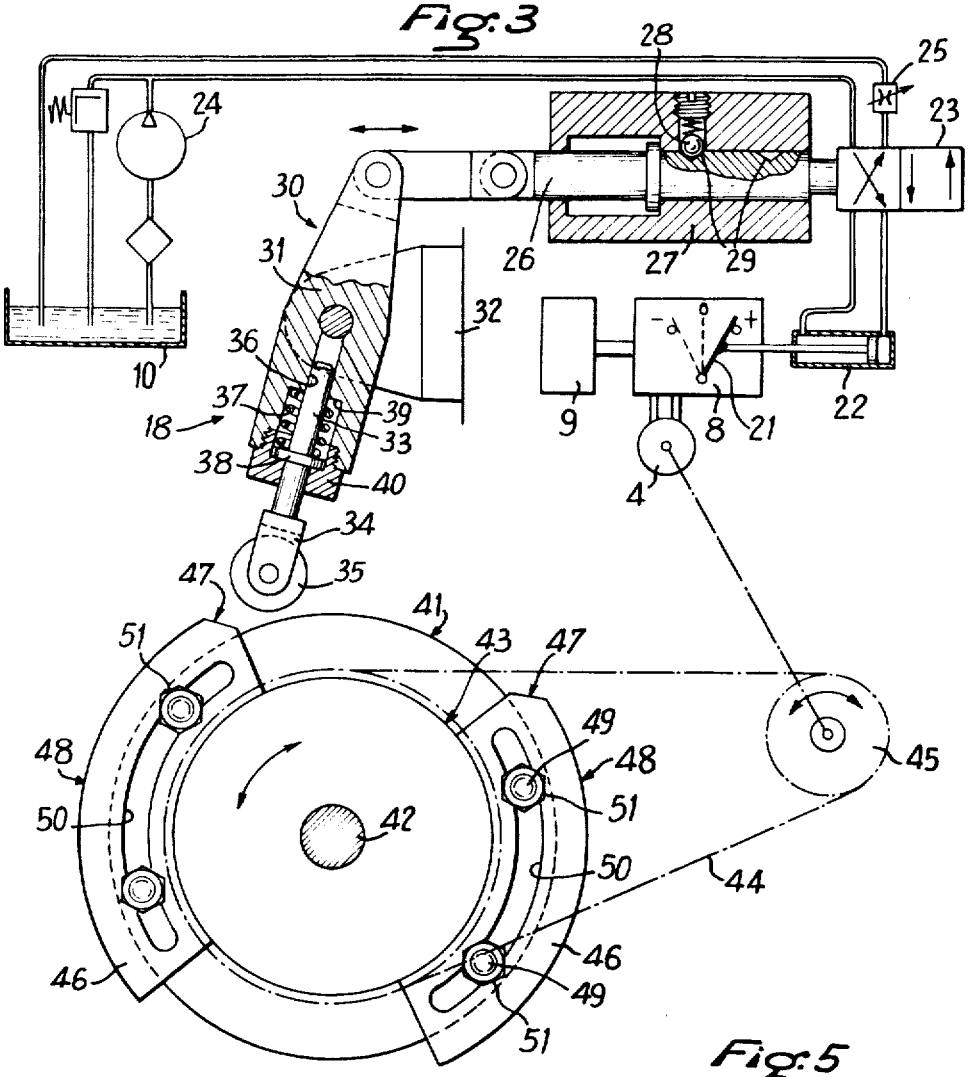
FIG. 3 shows on a larger scale a detailed view of a drive mechanism used in the apparatus shown in FIG. 1, and also part of the hydraulic circuit of the said apparatus.
Figure 4:
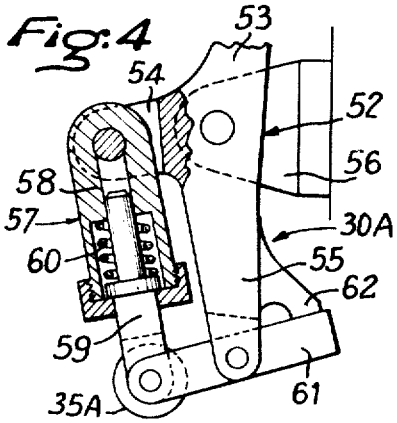
FIGS. 4 to 7 show various examples of possible alternative forms of the drive mechanism of the apparatus of the invention.
Figure 5:
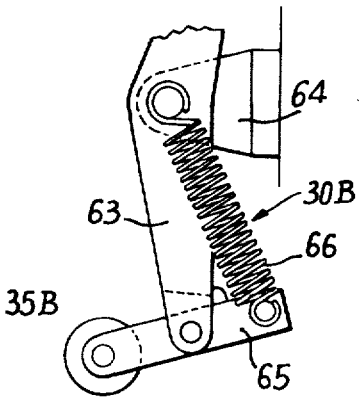

In FIGS. 4 and 5 are shown two possible modifications of the transmission mechanism 30 shown in FIG. 3.

The mechanism 30A of FIG. 4 contains a lever 52 having three arms 53 to 55, the arm 53 being articulated on the slide 26. The lever as a whole is articulated on a fixed yoke 56 and the second arm 54 starts transversely of the point of articulation of the lever on this yoke.

On this second arm 54 is mounted pivotally a telescopic connecting rod 57 comprising a tubular portion 58 and a coaxial rod 59, the arrangement being urged to extend by a compression spring 60. By its free end the rod 59 is attached to a lever 61 which is articulated approximately at its centre on the third arm 55 of the lever 52. A roller 35A similar to the roller 35 in FIG. 3 is mounted on the free end of the rod 59. The lever 61 is stopped by a heel 62 provided on the arm 55.

In this alternative arrangement the transmission mechanism 30A pivots as a whole when the roller 35A comes into contact with one or the other of the inclined surfaces 47, while when this roller is moving on the area 48 the connecting rod 57 is compressed and the lever 61 is slightly disengaged from the heel 62 against the action of the spring 60.

In FIG. 5 the transmission mechanism 30B comprises a single lever 63 articulated on a fixed yoke 64. One of its arms is attached to the slide 26, while the other is articulated on a rocking lever 65 carrying at one of its ends a roller 35B similar to the roller 35 in FIG. 3, the other end being connected to a spring 66 which is also attached to a fixed point on the yoke 64. In this case the spring 66 works by tension when the roller 36B is moving on the areas 48.

Figures 6, 7:
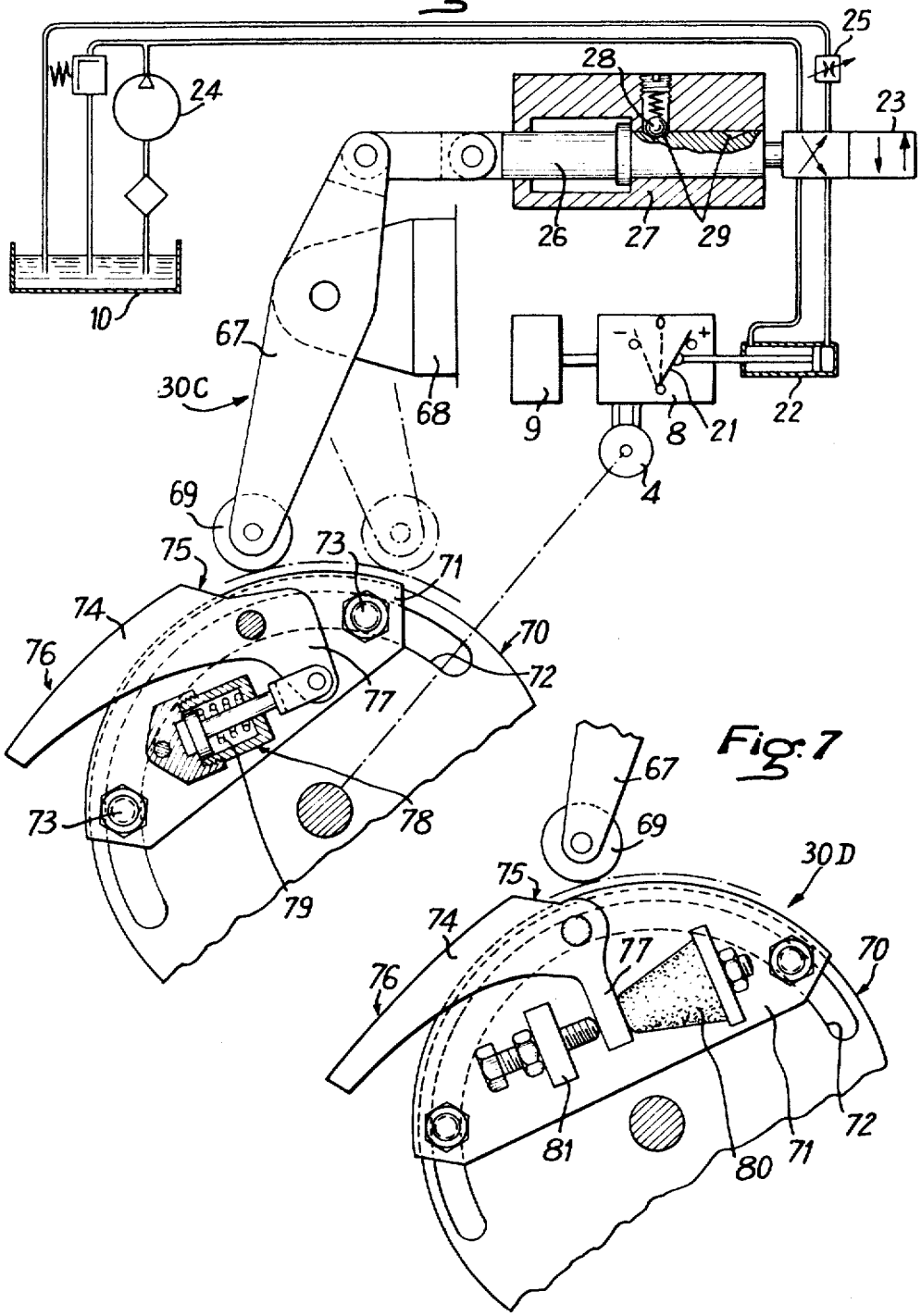

FIGS. 6 and 7 show two alternative forms of the transmission mechanism.

In FIG. 6 it can be seen that the transmission mechanism 30C comprises a single lever 67 articulated on a fixed yoke 68 which is attached to the slide 26. The latter is arranged in the same manner as in the embodiment shown in FIG. 3. At its free end the lever 67 carries a roller 69 serving the same purpose as the rollers 35, 35A and 35B in FIGS. 3 to 5.

The mechanism contains a wheel 70 coupled to the wheel 6 (FIG. 1) and carrying two sectors 71 (only one sector is visible in the drawing). The position of each sector is adjustable angularly with the aid of a curved hole 72 formed in the wheel 70 and of two screw and nut assemblies 73. A cam 74 is articulated on the sector 71 and has a front inclined surface 75 followed by a curved surface 76. The cam is provided with a foot 77 which is attached to a telescopic connecting rod 78 likewise articulated on the sector 71. The connecting rod 78 is acted on by a spring 79. The first stage of the reversal of the direction of movement (rocking of the lever 67) takes place in the same manner as in the embodiment shown in FIG. 3. On the other hand, in the course of the second stage the roller 69 causes the cam 74 to pivot about its axis of articulation. By means of the spring 79 the cam 74 remains pressed against the roller 69 as long as the reversal of the position of the lever 21 has not actually taken place, and also during the beginning of the movement in the opposite direction. During this time the roller rolls on the surface 76 beyond its point of impact with the inclined surface 75 and deforms the connecting rod 78. The surface 76 is indispensable because, if it did not exist the roller 69 would be released by the cam 74 shortly after impact with the inclined surface 75 and, on return of the cam once the reversal had been made the roller would be operated again and the distributor 23 would immediately rock back, so that the movement would oscillate indefinitely about the reversal point, without being able to leave this point.

In the variant 30D in FIG. 7 the connection rod 78 is replaced by an elastic stop 80 fastened to the sector 71 and co-operating with the foot 77 of the cam 74. In this case, an adjusting screw 81 is also provided which enables the elastic stop 80 to be adjusted to a value which is just sufficient to operate the distributor 23 without pivoting the cam 74 (first stage of the reversal of the movement).

Figure 8:
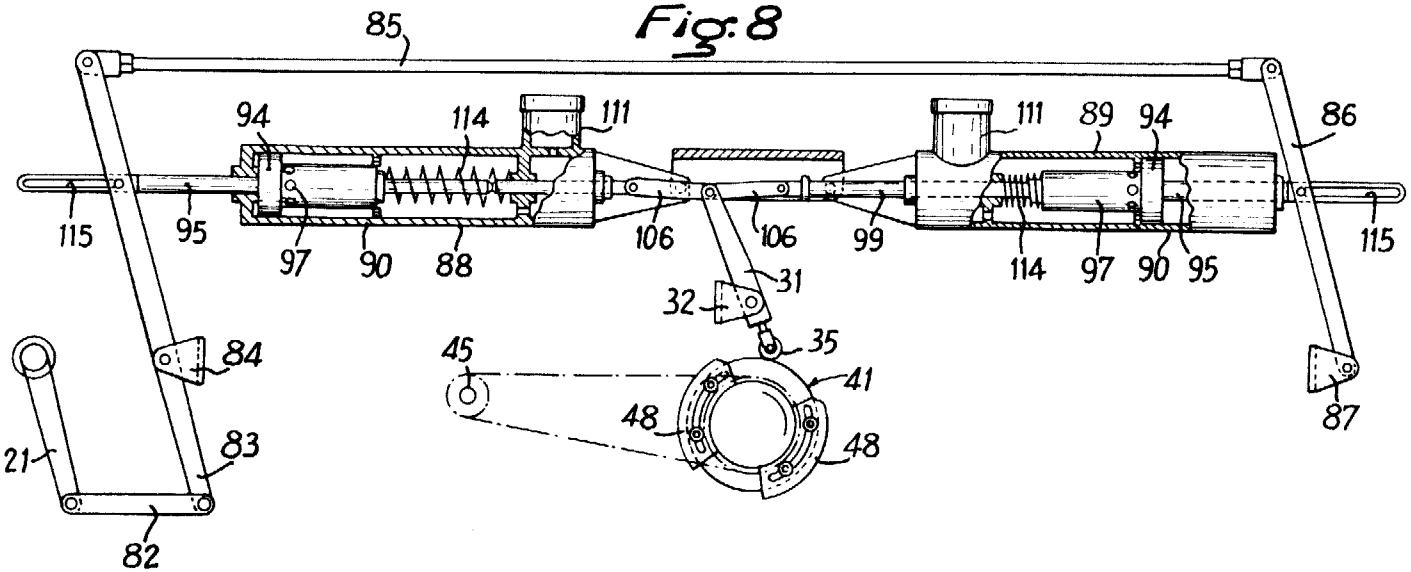
FIG. 8 is a diagrammatical view, partly in section, of a coupling device constituting the connection between the pump control element and the rocking lever of the drive mechanism.
Figure 9:
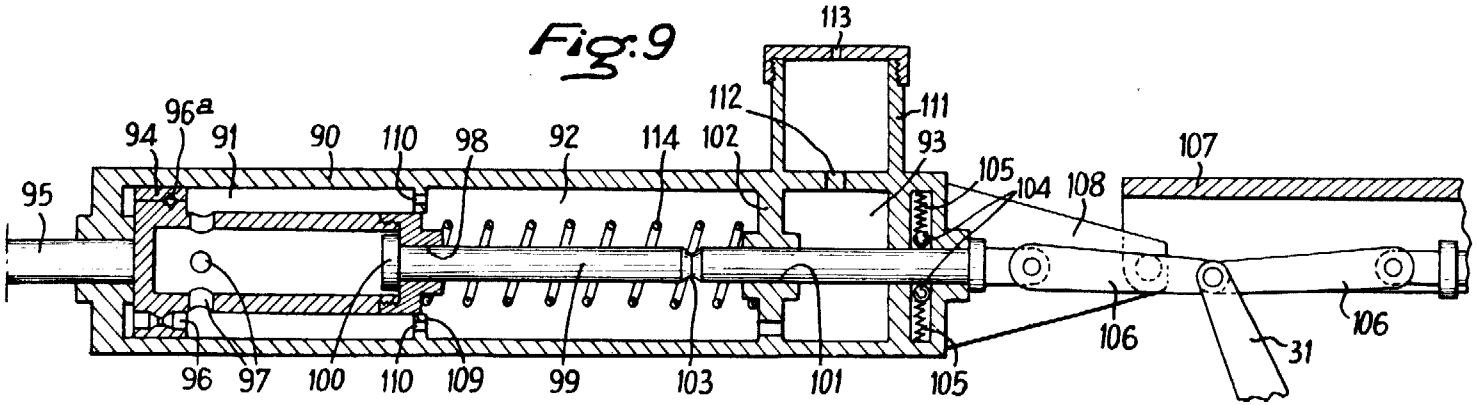
FIG. 9 is a view in section, on a larger scale, of a shock absorber used in the coupling device shown in FIG. 8.

FIGS. 8 and 9 show a preferred form of construction of a coupling effecting connection between the rocking lever and the pump adjusting element. Although these Figures show this device incorporated in the mechanism shown in FIG. 3, it is possible to use it with all the embodiments previously described, by making the necessary adaptations.

The coupling devices described above are of the hydraulic type and are suitable for most existing types of variable delivery pumps. They have the advantage that they may be equipped with a time delay device (throttle 25) and be used with adjusting elements for these pumps, whose drive requires relatively considerable energy.

Nevertheless, in the case of a variable delivery pump which has its own servo control for the adjusting element, the force to be supplied may be very slight. In this case, the direct coupling device shown in FIGS. 8 and 9 may be very advantageous.

This coupling device comprises a linkage composed of a connecting rod 82, a lever 83 articulated on a fixed yoke 84, a rod 85, and a lever 86 articulated on a yoke 87. An assembly comprising two shock absorbers 88 and 89 is mounted between the levers 83 and 86. These shock absorbers are identical, and one of them is shown in detail in FIG. 9. It comprises a cylindrical body 90 in which three chambers 91 to 93 are formed. A piston 94 is mounted for sliding in the first chamber 91 and is integral with a rod 95 which passes through the end wall of the body 90 and is articulated on the corresponding lever 83 or 86. The piston has a calibrated axial orifice 96 and a non-return valve **96*a*, and at the rear is extended by a coaxial hollow sleeve 97, ending in a bearing 98.**

The latter receives a slidable rod 99, provided with a head 100, passing through the second and third chambers 92 and 93. This rod slides in a bearing 101 provided in the partition 102 separating these chambers. The rod has a locating notch 103 cooperating with two balls 104 urged resiliently in the radial direction and accommodated in a compartment 105 at the end of the shock absorber body. At the opposite end to the piston 94 the rod 99 is articulated on one of the connecting rods 106 forming part of a toggle joint whose central articulation is connected to the lever 31. The body 90 of the shock absorber is articulated on a fixed angle 107 by means of a lug 108 integral with it.

The partition 109 separating the chambers 91 and 92 has a plurality of calibrated apertures 110 bringing these chambers into communication. The chamber 93 is in communication with a buffer reservoir 111 through the aperture 112 provided in the wall of the body 90. The reservoir 111 is in communication with the atmosphere by way of an aperture 113.

Finally, a calibrated compression spring 114 surrounding the rod 99 bears at one end against the rear face of the sleeve 97 and at the other end against the partition 102 separating the chambers 92 and 93.

When one of the cams 48 rocks the lever 31 in the corresponding direction, the following operations take place simultaneously:

1. The connecting rod 106 releases the rod 99 at its stop notch (right-hand shock absorber in FIG. 8). The spring 114 then progressively moves the piston 94, whose speed of advance is dependent on the strength of the spring 114 and the diameter of the calibrated orifice 96. The rod 95 then pushes the lever 86, whose movement entails that of the lever 21 of the pump to the desired position corresponding to a given delivery. This position is determined by adjustable stops (not shown).

2. The connecting rod 106 of the other shock absorber (that shown on the left in FIG. 8) rapidly loads the spring 114 of the latter, whose piston 94 is brought back without resistance because of the complete opening of the non-return valve **96*a* incorporated in it. The balls 104 then keep the spring 114 compressed (notch 103 of the rod 99) until the next reversal takes place, when it will be freed by the other cam 48.**

In FIG. 8 it can be seen that the rods 95 are provided with a slot 115, which is indispensable in order to enable the phase 2 described above to take place without acting on the lever 21, the movement of which is part of phase 1. The two phases are therefore initiated simultaneously, but there is thereupon no interference between them, because the fact of loading one of these springs 114 does not apply any force on the spring 114 of the other shock absorber which acts on the lever 21.

We claim:

1. Apparatus for maintaining a permanent reciprocating movement of a mechanical arrangement, particularly a pump unit, comprising a wheel coupled to the mechanical arrangement and fastened on the shaft of a hydraulic motor which is fed by a variable delivery pump provided with an adjusting element which, through a change of position, effects the reversal of delivery of the said pump control means operatively connected to said pump for effecting reversal of the pump delivery, the apparatus comprising in addition a drive mechanism for coupling the said adjusting element to the said wheel, the said drive mechanism comprising a mechanical transmission mechanism containing a rocking lever coupled to the said control means, a cam carrier wheel rotationally fixed to the said wheel and carrying two cams angularly spaced on the periphery of the cam carrier wheel, each cam having an inclined surface for effecting rocking of the said lever respectively to one or the other of its positions, and a circular surface for maintaining the lever in its rocked position for a certain period of time after the rocking, a resilient device being provided which is connected between the said lever and the said cam carrier wheel in order to keep the lever and the cams coupled during the aforesaid period of time.

2. An apparatus according to claim 1, wherein the cams are mounted with angular adjustability on the said cam carrier wheel.

3. An apparatus according to claim 1, wherein one end of the said rocking lever is fastened to a cam follower, preferably a roller co-operating alternately with the said cams.

4. An apparatus according to claim 3, wherein said resilient device is in the form of a rod mounted telescopically in the said lever with the interposition of a spring and carrying the said cam follower at its free end.

5. An apparatus according to claim 1, wherein the said resilient device is a telescopic connecting rod urged to extend by a spring and the said connecting rod is articulated on the one hand on the said rocking lever and on the other hand on an auxiliary lever which is mounted oscillatably at the free end of the rocking lever, the said cam follower being disposed at the point of connection between the said auxiliary lever and the said connecting rod.

6. An apparatus according to claim 3, wherein at its free end the said rocking lever is provided with an auxiliary oscillating lever carrying at one end the said cam follower and being connected by its other end to a tension spring which is also attached to a fixed point.

7. An apparatus according to claim 3, wherein each of the said cams is articulated on the said cam carrier wheel and connected to the latter by means of the said resilient device in such a manner that its circular surface is urged outwards.

8. An apparatus according to claim 7, wherein the said resilient device is a telescopic connecting rod urged to contract by a spring and connected on the one hand to a foot of the cam and on the other hand to the said cam carrier wheel.

9. An apparatus according to claim 7, wherein the said resilient device is a stop fastened to the said cam carrier wheel and the cam carries a foot which is supported against the said stop by an adjusting device.

10. An apparatus according to claim 7, wherein the said cam is articulated on a sector fixed with angular adjustability on the said cam carrier wheel.

11. An apparatus according to claim 1, wherein the aforesaid drive mechanism contains in addition a coupling device for connecting the said rocking lever to the said adjusting element, this device comprising a power cylinder operating the said adjusting element and a hydraulic reverser connected to the said power cylinder and operated by the said rocking lever.

12. An apparatus according to claim 11, wherein the hydraulic reverser is connected to the said rocking lever by means of the slide sliding in a mounting the two end positions of the slide being fixed by a click device.

13. An apparatus according to claim 1, wherein the said drive mechanism contains in addition a coupling device for connecting the said rocking lever to the said adjusting element, this device comprising two shock absorbers operated in opposition by the said rocking lever and connected to the said adjusting element by means of a linkage permitting simultaneously the slackening of one of the shock absorbers and the tightening of the other shock absorber, or vice versa in dependence on the position of the rocking lever.

* * * * *